US007698145B2

(12) United States Patent
Norsworthy et al.

(10) Patent No.: US 7,698,145 B2
(45) Date of Patent: Apr. 13, 2010

(54) PET FOOD KIOSK

(75) Inventors: Gregory J. Norsworthy, Lexington, KY (US); Bryan Wilson Badger, Kirkwood, MO (US); Bhajmohan (Ricky) Singh, St. Louis, MO (US); Robert Carvalho, Ballwin, MO (US)

(73) Assignee: Nestec S.A., Vevey (CH)

( * ) Notice: Subject to any disclaimer, the term of this patent is extended or adjusted under 35 U.S.C. 154(b) by 1624 days.

(21) Appl. No.: 09/882,198

(22) Filed: Jun. 15, 2001

(65) Prior Publication Data

US 2003/0004733 A1 Jan. 2, 2003

(51) Int. Cl.
*G06Q 10/00* (2006.01)

(52) U.S. Cl. ..... 705/1

(58) Field of Classification Search ..... 296/22, 296/24.1; 52/67, 66; 361/384; 5/417; 426/232, 426/302, 104, 623, 635; 514/682; 600/300; 312/7.2; 119/51.01, 51.02, 53, 174, 421; 423/805

See application file for complete search history.

(56) References Cited

U.S. PATENT DOCUMENTS 4,006,266 A 2/1977 Bone et al.
4,179,723 A * 12/1979 Spencer ..... 361/687
4,273,788 A * 6/1981 Bone et al. ..... 426/104
4,601,509 A * 7/1986 Ellis, Sr. ..... 296/22
4,712,511 A * 12/1987 Zamzow et al. ..... 119/51.02
5,105,767 A * 4/1992 Gordon et al. ..... 119/57.92
5,424,957 A * 6/1995 Kerkhoff et al. ..... 700/240
5,711,231 A * 1/1998 Couvrette et al. ..... 109/2
5,787,719 A * 8/1998 Wilson ..... 62/236
5,894,029 A * 4/1999 Brown et al. ..... 426/302
5,954,640 A * 9/1999 Szabo ..... 600/300
6,060,093 A * 5/2000 Davis et al. ..... 426/74
6,098,346 A * 8/2000 Miller et al. ..... 52/67
6,146,270 A * 11/2000 Huard et al. ..... 463/12
6,189,944 B1 * 2/2001 Piche ..... 296/22
6,198,944 B1 * 3/2001 Hollenbach et al. ..... 455/557
6,247,879 B1 * 6/2001 Costa ..... 408/112
6,254,910 B1 * 7/2001 Paluch ..... 426/282
6,291,533 B1 * 9/2001 Fleischner ..... 514/682
6,312,746 B2 * 11/2001 Paluch ..... 426/282
6,358,546 B1 * 3/2002 Bebiak et al. ..... 426/232
6,427,879 B1 * 8/2002 Caldwell ..... 222/465.1

(Continued)

FOREIGN PATENT DOCUMENTS

JP 10295283 * 11/1998

(Continued)

OTHER PUBLICATIONS

Carlson, Barbara; Health Food Fanciers and Four-Legged Friends, May 1989, Business Dateline (R) (c) 1989 UMI, vol. 11, No. 5, Section 1, pp. 5.*

(Continued)

*Primary Examiner*—Dennis Ruhl
*Assistant Examiner*—Gerardo Araque, Jr.
(74) *Attorney, Agent, or Firm*—K&L Gates LLP

(57) ABSTRACT

A kiosk configured for selling and manufacturing customized food for a pet is disclosed. The kiosk comprises a customer interface area, a biological sample analysis and handling area, a base product display area, a product additive storage area, and an ingredient mixing and customer observation area.

19 Claims, 3 Drawing Sheets

U.S. PATENT DOCUMENTS

| | | | | |
|---|---|---|---|---|
| 6,531,104 | B1 * | 3/2003 | Borio et al. | 423/243.01 |
| 6,669,975 | B1 * | 12/2003 | Abene et al. | 426/232 |
| 6,681,717 | B2 * | 1/2004 | Burghardi et al. | 119/51.02 |
| 6,754,919 | B2 * | 6/2004 | Leaphart et al. | 5/417 |

FOREIGN PATENT DOCUMENTS

| | | | |
|---|---|---|---|
| JP | 2002186430 | * | 7/2002 |
| JP | 2002335872 | * | 11/2002 |
| JP | 2003102390 | * | 4/2003 |

OTHER PUBLICATIONS

Stewart, Laura; Bone Appetit Caters to Man's Best Friends; Daily Herald [Lake Edition]; Feb. 16, 2000; Paddock Publications; Arlington Heights, U.S.*

DeSilva, Craig; Going to the Dogs.; Hawaii Business; Jan. 2000, vol. 45 Issue 7, p. 44, 1 page, 1c; EBSCO Publishing; U.S.*

PCT International Search Report Dated May 15, 2003 (4 pgs.); In re International Application No. PCT/US02/18577: Filed Jun. 13, 2002.

Stewart, Laura; Bone Appetit caters to man's best friend; Daily Herald [Lake Edition]: Feb. 16, 2000: Paddock Publications: Arlington Heights, US.

Desilva, Craig; Going to the dogs.; Hawaii Business; Jan. 200, vol. 45 Issue 7, p. 44, 1p. 1c: EBSCO Publishing: US.

* cited by examiner

PET FOOD KIOSK

BACKGROUND OF THE INVENTION

This invention relates generally to methods for marketing pet foods, and more particularly, to an apparatus configured to the manufacture of a pet food customized to the health and nutrition requirements of an individual pet.

Retail pet food manufacturers typically manufacture their pet foods in large quantities and in only a limited number of formulations. Most manufacturers offer, for example, dog food in several flavors, and in a puppy formula, an adult dog formula, and a mature or inactive dog formula. Some manufacturers offer breed-specific or size-specific formulas. In addition, some manufacturers offer more specialized formulas for dogs having specific food allergies or nutrient responsive diseases. Similarly, retail cat food is typically offered in a limited variety of formulas having different flavors or for different stages of development. However, all of the above described food selections are for a totally pre-made product and hence the range of pet food choices is not necessarily compatible with the highly variable preferences and dietary requirements of individual pets. Thus, making a selection to suit a particular pet's dietary needs is sometimes difficult and sub-optimal. For example, an individual pet may have specific dietary requirements because of an existing illness or disease, or because of a genetic predisposition towards a particular disease. Further, the existing variety of pet food choices typically available at, for example, retail outlets, makes it difficult for pet owners to choose the food which most closely meets their own pet's nutrient needs. In addition, once a food is chosen, knowing how to feed the food correctly can be difficult.

BRIEF SUMMARY OF THE INVENTION

In one aspect, a kiosk is provided which is configured for selling and manufacturing a customized food for a pet. The kiosk comprises a customer interface area, a biological sample analysis and handling area, a base product display area, a product additive storage area, and an ingredient mixing and customer observation area.

In another aspect, a method is provided for marketing a customized food product for a pet using a kiosk, where the kiosk includes at least one of a consumer interaction station, an analysis station, and a workstation. The method comprises providing a questionnaire at the consumer interaction station to profile the pets, performing an analysis of a biological sample for a pet at the analysis workstation, determining a customized pet food product based on the questionnaire answers and the biological sample, and preparing a sample of the customized product for the consumer at the workstation.

DETAILED DESCRIPTION OF THE INVENTION

Exemplary embodiments of apparatus and methods for marketing customized pet products are described below. The apparatus and methods facilitate the manufacture of a customized product that is directed to the specific needs of an individual pet. As used hereinafter, pet product includes pet foods as well as pet food components. Although the pet products may include food components that are manufactured in bulk, i.e., pre-made, the pre-made components are combined with customized products to produce an end product that is customized to the particular needs of an individual pet. Thus, the phrase customized product includes products that have no pre-made food components as well as products that include pre-made food components and custom made products. In addition, although the method is often described in terms of a complete process, it should be understood that any portion of the process can be used separately or in combination with any other portion of the process described hereinafter.

Figure 1:
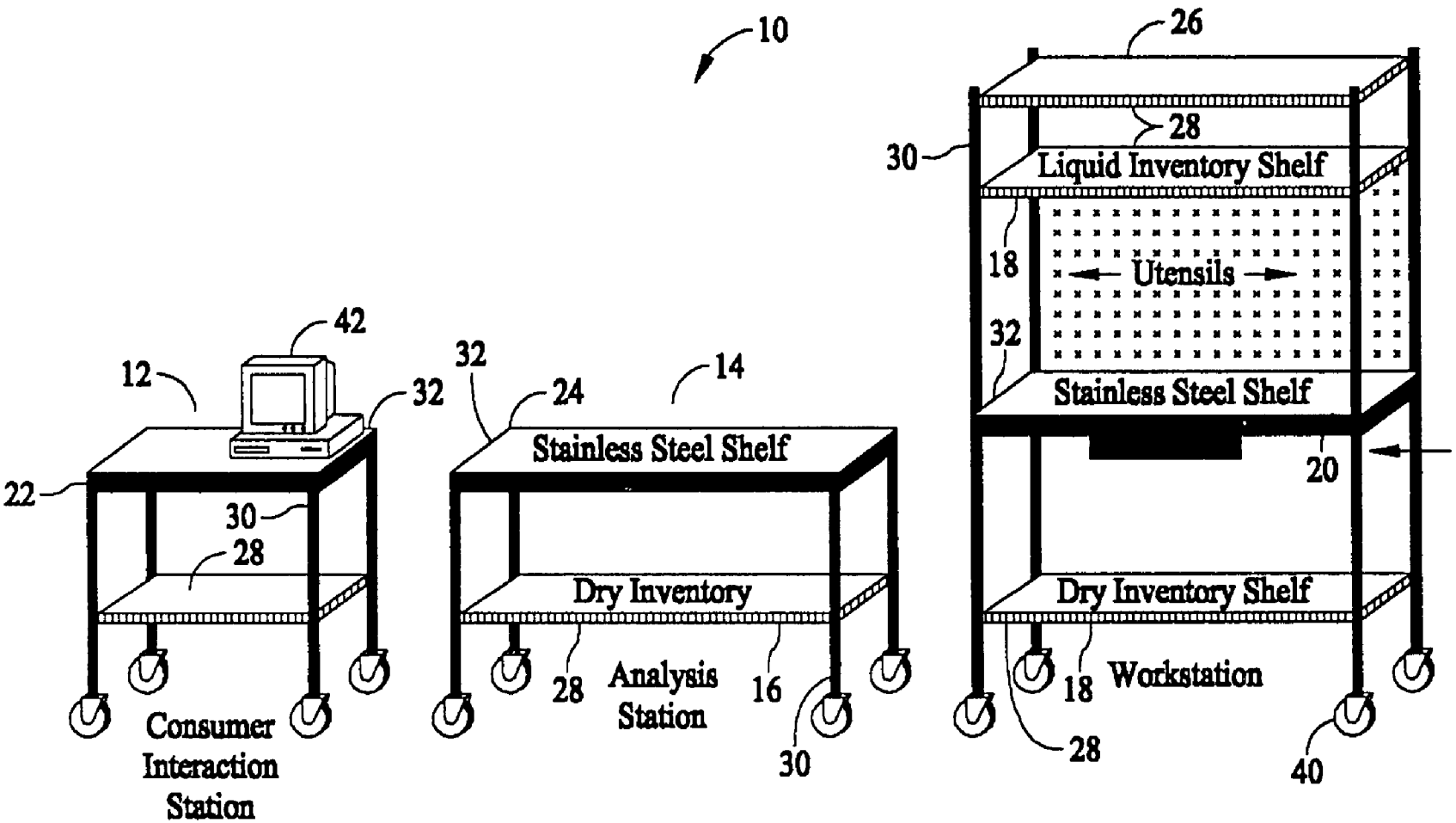
FIG. 1 is a simplified kiosk for marketing a customized pet food.

FIG. 1 is a simplified diagram of a kiosk 10 according to one embodiment of the present invention. In the embodiment shown in FIG. 1, kiosk 10 includes a customer interface area 12, a biological sample analysis and handling area 14, a base product storage area 16, at least one product additive storage area 18 and an ingredient mixing and customer observation area 20. In one embodiment, product additive storage area 18 includes dry inventory storage and liquid inventory storage. In the exemplary embodiment, areas 12, 14, 16, 18 and 20 described above are incorporated into three stations, a consumer interaction station 22, an analysis station 24, and a workstation 26. In a further exemplary embodiment, consumer interaction station 22, analysis station 24, and workstation 26 are constructed using at least one of wire shelving 28, stainless steel supports 30, plastic bins (not shown), drawers (not shown) and laminated wood or steel shelves 32. A height of shelves 32 and wire shelving 28 is adjustable so that a kiosk operator (not shown) can arrange kiosk 10 in a manner that is most efficient for that operator. In one embodiment, consumer interaction station 22 includes brochures describing the customized pet food product. In an alternative embodiment, biological sample analysis and handling area 14 is configured with a biological sample disposal area (not shown). In still another embodiment, biological sample and analysis and handling area 14 is configured with a computer (not shown) used for analysis of the biological samples along with other instruments, including, but not limited to, a microscope and utensils.

Kiosk 10 includes a set of wheels 40, and is configured to be portable. Although not shown in FIG. 1, in other embodiments, kiosk 10 is configured to be covered and locked, for security when, for example, kiosk 10 is located in a shopping mall. One method for covering kiosk 10 includes a custom cover, made for example, from canvas, which slips over kiosk 10, and is locked to kiosk 10 in the vicinity of wheels 40. Further, kiosk 10 is configurable to be expanded or contracted based upon the space available. In an alternative embodiment, workstation 26 includes the functionality of analysis station 24, thus providing a kiosk with two stations, and base product storage combined with product additive dry storage. Being expandable and contractable allows for placement of kiosks, in various configurations, for example, at the end cap of an aisle in a store, or alternatively, freestanding such as in a shopping mall. Not shown in FIG. 1, and depending upon a location (e.g. veterinarian, shopping mall, pet food store) of each individual kiosk, kiosk 10 is configurable to include graphic side panels and other advertising materials to draw attention of consumers to kiosk 10.

In one embodiment, consumer interaction station 22 includes a computer 42 for storing custom pet product groupings for one or more pets analyzed, where the consumer can return to kiosk 10 to quickly purchase additional supplies of the pet product in either a completed form, or alternatively, the consumer purchases the product additives, dry or liquid, for adding to a base product which can be purchased elsewhere.

Figure 2:
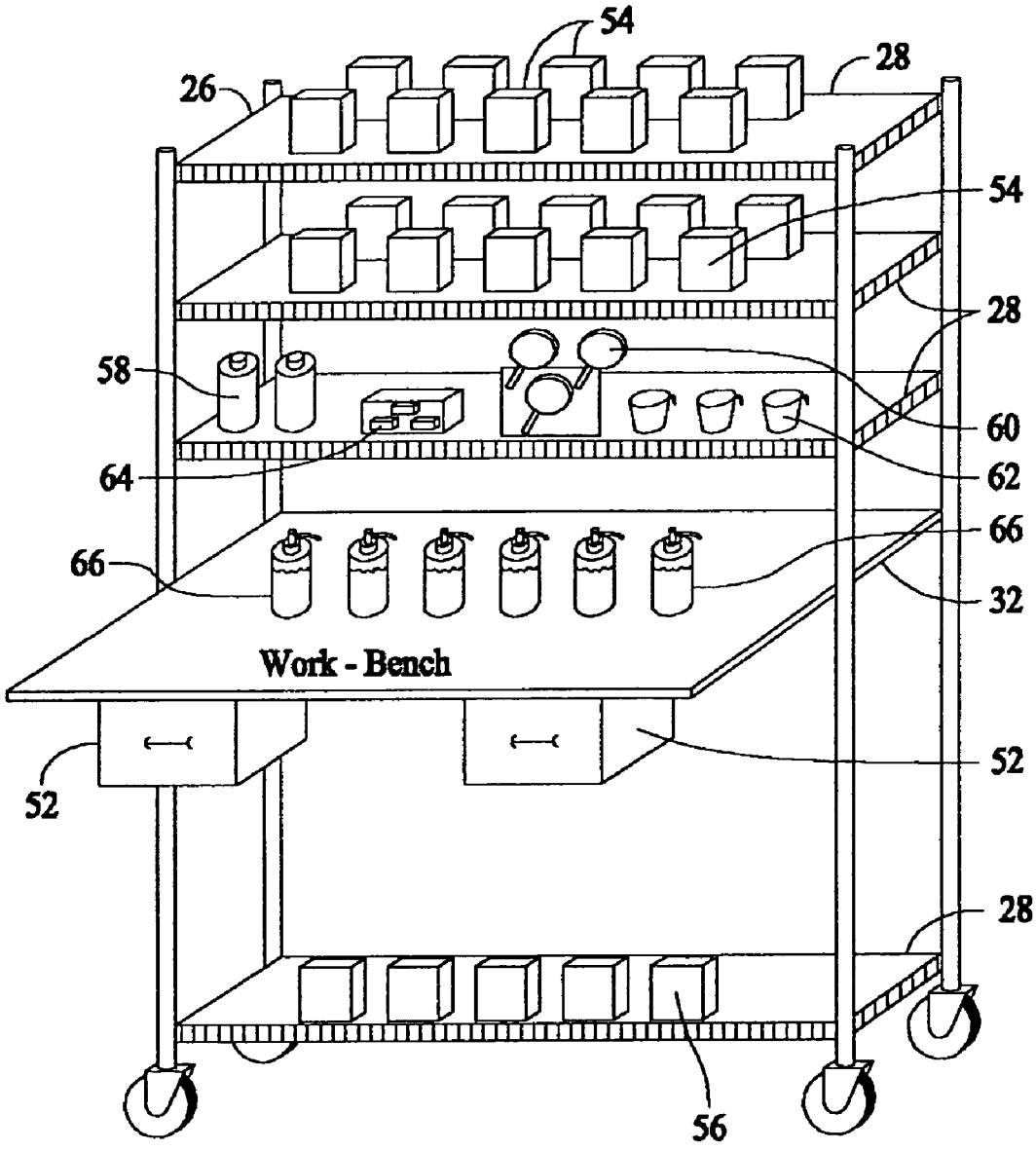
FIG. 2 is a diagram of a workstation used to customize pet food.

FIG. 2 is a diagram of one embodiment of workstation 26. Components of workstation 26, identical to those components shown in FIG. 1, are identified in FIG. 2 using the same reference numerals as used in FIG. 1. Referring specifically to FIG. 2, workstation 26 includes wire shelving 28 for storage, a steel shelf 32 used as a work surface, and drawers 52 for storage of supplies used by the kiosk operator (not shown). Stocked on wire shelves 28 are bags of base formula food (kibble) 54 and other dry ingredients 56. In one embodiment, there are multiple varieties of base formula foods 54, and the variety used in developing a customized food for a particular pet is based upon the pet's needs, as further described in an example below. Further stocked on shelves 28 are empty bottles 58 used to provide additives to customers, measuring spoons 60 and measuring cups 62 which are provided to customers as part of the customized pet food purchase or sold separately.

As the kiosk operator prepares customized food for a pet, which is placed in bottle 58 for presentment to a customer, the operator prepares a customized additive for the particular pet using at least one of packets 64 of dry additive or one of a variety of liquid additives stored in dispensers 66. Other dry ingredients 56 include at least one of base formula foods 54, extra bottles 58, packets 64, spoons 60 and cups 62 stored in bulk. As described in further detail below, the kiosk operator prepares a custom additive, using at least one of packets 64 and liquids in dispensers 66 to be stored in bottle 58 and presented to the customer. In one embodiment, the dry ingredients in packets 64 and the liquids in dispensers 66 include multiple, different varieties for preparing unique customized additives to be added to one of base formula foods 54.

Figure 3:
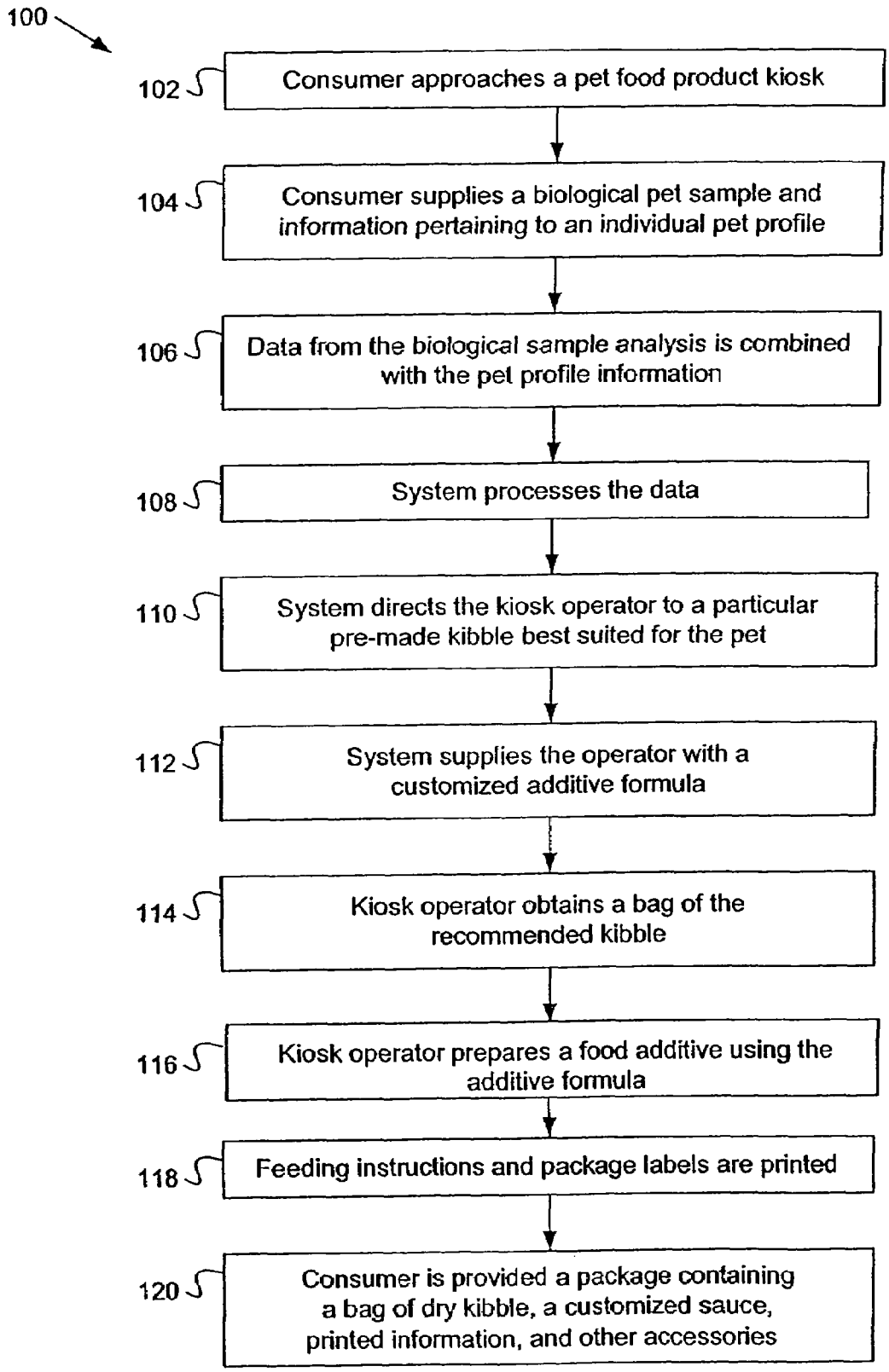
FIG. 3 is a flowchart illustrating a customized pet food marketing process.

FIG. 3 illustrates a method 100 of obtaining a customized pet food product utilizing kiosk 10 (shown in FIG. 1). In an exemplary embodiment, a pet owner (consumer) that is a first-time purchaser of a customized pet food product approaches 102 pet food product kiosk 10, or booth, located in a retail location, including but not limited to, a mall, a store, a veterinarian office, a clinic, an airport, and an outdoor event. In other embodiments, customer interest is solicited through any one of direct mail, electronic mail, brochures and telephone. The consumer supplies 104 a biological sample (i.e., stool sample) and completes a questionnaire, typically at customer interaction station 22 (shown in FIG. 1) of kiosk 10. The questionnaire is provided in advance of the visit on the Internet, in the mail, or personally picked up and answered at kiosk 10. The questionnaire profiles the pet. In an alternative embodiment, customer interest is solicited by supplying a customer with a bag to contain a biological sample for analysis at kiosk 10 using a direct mail campaign.

In one embodiment, analytical data is obtained from the biological sample by a veterinarian/technician located on site, for example at biological sample and analysis and handling area 14 (shown in FIG. 1). In an alternative embodiment, the sample is sent to a central lab for analysis. The analysis is performed on the biological sample with respect to examining several health and digestive indicators. Data from the biological sample analysis is combined 106 with the pet profile information and entered into a system, for example, computer 42 (shown in FIG. 1), including a pet food product customization model. Alternatively, the biological sample analysis is forwarded by the pet's veterinarian to the kiosk operator and the results are incorporated into the pet profile.

The system processes 108 the data utilizing at least one algorithm and generates a pet profile. Each profile has a unique identifying code and contains the specific customized food product and feeding instructions recommended for the specific pet. The recommended food product includes a pre-manufactured kibble, typically stored at base product display area 16 (shown in FIG. 1), the kibble being sometimes referred to as base formula food 54, and a customized additive, sometimes referred to herein as a sauce. In one embodiment, the pre-manufactured kibble is selected from a variety of pre-manufactured base formula foods 54 (shown in FIG. 2) and the additive is a liquid additive that is made on site, typically in the presence of the consumer, and typically at mixing and observation area 20 (shown in FIG. 1). The system directs 110 the kiosk operator to the pre-manufactured kibble best suited for the pet and supplies 112 the operator with a customized additive formula that has been created based upon the individual pet's profile. Alternatively, the system indicates a recommendation for the pet to see a veterinarian prior to buying a customized food, if certain "warning" signs are present in the profile. This warning provides the consumer with added health information about the pet between regular vet visits.

The kiosk operator then obtains 114 a bag of the recommended kibble and prepares 116 a food additive in bottle 58 (shown in FIG. 2) using an additive formula at workstation 26, including, but not limited to, a sauce, a gravy, a topping, a thickener, a powder, and a coating, utilizing the customized additive formula. In the exemplary embodiment, a sauce is made. In addition, customized feeding instructions and package labels are printed 118. The consumer is provided 120 a package containing a bag of dry base formula food 54, such as kibbles, a bottle 58 of customized sauce, printed information, a customized measuring cup 62 (shown in FIG. 2) for the dry kibbles, a custom-selected spoon 60 (shown in FIG. 2) for measuring the sauce into the food bowl, and any other accessories associated with the custom food purchase. Additionally, the consumer receives information about the recommended frequency and conditions of future biological sample analyses and/or profile updates for their pet.

In an alternative embodiment, the pet profile is utilized by the system to direct the kiosk operator to a pre-manufactured kibble (base formula food 54) best suited for the pet and a pre-manufactured sauce best suited for the pet. The kiosk operator provides the consumer with the appropriate pre-manufactured kibble and pre-manufactured sauce and the consumer mixes the appropriate amounts of each for the pet.

For a repeat purchase, a consumer returns to kiosk 10 and provides their pet's unique code, generated during a previous visit, to access their pet's profile. They may update/change the profile information and/or provide a new biological sample, either of which could result in a difference in the recommended food, either the base formula food 54 or the product additive or both. Alternatively, the consumer leaves the profile as is and replenishes their pet's current food supply.

The process described above is further illustrated by an example.

EXAMPLE

A pet questionnaire is administered regarding a pet named "Bruno" at a remote manufacturing location, such as a retail store. The questionnaire is completed by Bruno's owner and the following information, among other information, is obtained about Bruno, and provided to the operator of kiosk 10.

| | |
|---|---|
| Name of pet: | Bruno |
| Breed of Pet: | Golden Retriever |
| Weight: | 65 lbs |
| Age: | 4 Years |
| Gender: | Male |
| Spayed/Neutered: | Yes |
| Activity Level: | Moderate |
| Season: | Summer |
| Feeding Method: | Measured |
| Snack Schedule: | Once a day |
| Flavor Preference: | Chicken for Base and Beef Stew for Sauce |
| Body Condition: | Ideal/Fit |

In addition or in a subsequent visit, Bruno's owner delivers a typical stool sample of Bruno to the kiosk operator where the feeding and care program is being administered. The following stool sample analyses of Bruno is performed.

| | |
|---|---|
| Moisture: | Normal |
| Texture: | High-Above Normal |
| Discomfort: | Yes |
| Particulates: | None |
| Color: | Normal |
| Mucin: | None to Normal |
| Parasites: | None |

Based on the above information, a pre-manufactured kibble (Base B2) is selected that is appropriate for adult, medium sized dogs with a moderate level of activity, good body condition score, the desired flavor preference and no other special health condition. Based on the kibble selected, a pre-manufactured sauce is selected (S4) which is appropriate for dogs with hard stool and/or fecal straining issues. The sauce is formulated to be distributed in a 10 oz. bottle and to complement a 5 lb. bag of dry kibble. The sauce's composition is:

| | |
|---|---|
| Sauce Percentage | 12.50% |
| Base Code | B2 (Adult) |
| Sauce Code | S4 Overweight w/Fiber |
| Formula No. | Beef Stew |

| Ingredient Name | Step % | Formula % | Grams |
|---|---|---|---|
| Animal Digest | 15.2% | 1.90% | 48.6 |
| Sodium Bisulfate | 3.8% | 0.48% | 12.2 |
| Deionized Water | 56.2% | 7.03% | 180.0 |
| Sorbic Acid | 0.2% | 0.02% | 0.6 |
| Psyllium | 0.6% | 0.07% | 1.8 |
| Corn Oil | 16.00% | 2.00% | 51.2 |
| Lactulose | 8.00% | 1.00% | 25.6 |
| Beef Stew Flavor | 0.20% | 0.03% | 0.6 |
| Total Percentage | 100.0% | 12.50% | 320.6 |

Next, an appropriate daily feeding amount is calculated based on the nutrient profile and "sauce" selected, the weight of the dog, body condition, season of the year and snacking habit. Both the pre-manufactured kibble and the pre-manufactured sauce are given to the owner with feeding instructions and a copy of the above report. A copy of the individual pet profile and sample stool test is sent to Bruno's veterinarian.

The methods for customizing pet foods and pet products provide a way for pet food manufacturers to address the individualized health and nutrition requirements, and preferences, of individual pets and their owners. For example, the customized pet food and pet products can be tailored to provide a desired nutritional balance for a pet of a specific age, gender and weight, at a particular time of year, and having a specific health problem, such as, for example, a food allergy. Kiosk 10 provides means and a way for engaging consumers in the marketplace, to introduce the consumers to customized pet foods and further leaves an impression with the consumers of high quality pet and pet food products.

While the invention has been described in terms of various specific embodiments, those skilled in the art will recognize that the invention can be practiced with modification within the spirit and scope of the claims.

What is claimed is:

1. A kiosk configured for selling and manufacturing customized food for a pet, said kiosk comprising:

a customer interface area for receiving information regarding the pet;

a biological sample analysis and handling area for analyzing the biological information regarding the pet;

a computer for receiving information regarding the pet and generating a pet profile;

a base product display area;

at least one product additive storage area having at least one shelf; and an ingredient mixing and customer observation area.

2. A kiosk according to claim 1 wherein said biological sample analysis and handling area is configured with a biological sample disposal area.

3. A kiosk according to claim 1 wherein said kiosk is further configured to be expanded or contracted.

4. A kiosk according to claim 1 wherein said kiosk is further configured to be portable.

5. A kiosk according to claim 1 wherein said kiosk is further configured to be covered and locked.

6. A kiosk according to claim 1 further comprising a base product storage area.

7. A kiosk according to claim 1 wherein said kiosk is constructed from at least one of wire shelving, stainless steel supports, plastic bins, and laminated wood and stainless steel shelving.

8. A kiosk according to claim 1 wherein said at least one product additive storage area is stocked with at least one of a dry inventory and a liquid inventory.

9. A kiosk according to claim 1 wherein said kiosk comprises three separate units, including at least one of a consumer interaction station, an analysis station, and a workstation.

10. A kiosk according to claim 1 further comprising a computer configured to store at least one custom pet food for an individual pet profile.

11. A kiosk according to claim 1 further comprising graphics panels to advertise said kiosk and the functionality of said kiosk.

12. A method comprising:

providing the kiosk including at least one of a consumer interaction station, an analysis station and a workstation;

providing a questionnaire at the consumer interaction station for profiling pets;

performing an analysis of a biological sample for a pet at the analysis station;

receiving a customized pet food product formula based on the questionnaire answers and the biological sample at the analysis station; and preparing a sample of the customized product for the consumer at the workstation.

13. A method according to claim 12 further comprising storing results of the questionnaire and the biological sample analysis as a pet profile at the analysis station.

14. A method according to claim 13 further comprising using the pet profile stored at the analysis station to prepare additional portions of the product additive at the workstation for repeat consumers.

15. A method according to claim 12 wherein preparing a sample of the customized product at the workstation further comprises preparing a custom product additive to be added to a base formula.

16. A method according to claim 12 further comprising affixing graphics panels to at least one of the consumer interaction station, the analysis station, and the workstation.

17. A method according to claim 12 wherein preparing a sample of the customized product comprises adding at least one of a dry product additive and a liquid additive to the base formula.

18. A method according to claim 12 wherein receiving a customized pet food product formula further comprises modeling questionnaire responses and the analysis of the biological sample.

19. A method according to claim 12 wherein performing an analysis of a biological sample for a pet comprises performing the analysis using a computer located at the analysis station.

* * * * *